US007676851B2

(12) United States Patent
Koh

(10) Patent No.: US 7,676,851 B2
(45) Date of Patent: Mar. 16, 2010

(54) HEADWEAR PIECE WITH ORNAMENTATION

(76) Inventor: Ho-Seong (Harold) Koh, Sanga Apt. 4-1003, Samsung-dong, Kangnam-ku, Seoul (KR)

( * ) Notice: Subject to any disclaimer, the term of this patent is extended or adjusted under 35 U.S.C. 154(b) by 816 days.

(21) Appl. No.: 11/504,273

(22) Filed: Aug. 15, 2006

(65) Prior Publication Data

US 2008/0060607 A1 Mar. 13, 2008

(51) Int. Cl.
*A41D 27/08* (2006.01)

(52) U.S. Cl. ..... 2/246; 2/195.1

(58) Field of Classification Search ..... 2/244, 2/246, 195.1; 40/329, 1.5; 63/20
See application file for complete search history.

(56) References Cited

U.S. PATENT DOCUMENTS 37,056 A * 12/1862 Robinson ..... 2/246
1,326,604 A * 12/1919 Mason ..... 2/246
D95,381 S * 4/1935 Schlesinger ..... D11/112
5,974,997 A * 11/1999 Amburgey ..... 112/475.01

OTHER PUBLICATIONS

Australian Naval Uniforms: RAN and earlier—Female officers hatworn in 1999.*

* cited by examiner

*Primary Examiner*—Katherine Moran
(74) *Attorney, Agent, or Firm*—Wood, Phillips, Katz, Clark & Mortimer

(57) ABSTRACT

A headed piece having a crown defining an opening into which a wearer's head can be directed and a brim/bill projecting away from the crown. The crown has an inside surface for engaging a wearer's head, directed into the opening, to thereby maintain the headed piece in an operative position upon the wearer's head. The crown and brim/bill further have an exposed outside surface to which ornamentation is applied. The ornamentation includes bullion wire that is applied to the exposed outside surface so as to define at least a part of a viewable component that consists of at least one of: a) a scene; b) a logo; c) a design; d) a word; e) a letter; and f) a depiction of a: i) person; ii) place; and/or iii) thing.

18 Claims, 10 Drawing Sheets

HEADWEAR PIECE WITH ORNAMENTATION

BACKGROUND OF THE INVENTION

1. Field of the Invention

This invention relates to headed and, more particularly, to a headed piece having an exposed, outside surface upon which ornamentation is provided.

2. Background Art

The headed industry is becoming increasingly competitive. This is particularly true in the category of headed including baseball-style caps. Whereas, at one point in time, baseball-style caps were worn primarily by individuals participating in baseball-related activities, their use has now spread to an extent that these caps are worn regularly by a significant portion of the population for both sports related and leisure activities.

The basic construction of the baseball-style cap has not changed since its initial introduction. That is, the cap has a crown that embraces a wearer's head and a forwardly projecting brim/bill.

The baseball-style cap is desirable for a number of reasons. First of all, it is generally light in weight, with the brim/bill affording shielding of the faces of wearers thereof from sun and the other elements.

The baseball-style cap is also highly versatile, making it adaptable to many different uses and applications. Particularly in the last two decades, the baseball-style cap has gone from a relatively plain construction, to one integrating any of a multitude of different functional and aesthetic features. These developments have been spurred by the growing use of baseball-style caps by all different age groups, and have been recently propelled by the perceived, still untapped, base of potential customers. This potential in large part stems from the adaptability of the baseball-style cap to meet the many different tastes and needs of this customer base.

For example, the baseball-style cap is adapted to be used comfortably by men and women participating in many different types of sporting events, such as tennis, baseball, golf, etc. Baseball caps are commonly offered as souvenir items with pertinent information thereon at a multitude of different events, that vary significantly in terms of their nature, be it sporting, academic, etc. For example, baseball-style caps may be sold to commemorate an athletic team or an event in which a team participates. The information on the cap may be commemorative of a non-sporting event or may be such as to identify significant individuals, events, or places. As an alternative, the caps may have general advertising material thereon.

Accordingly, those offering headed, particularly baseball-style caps, and competing for business, are presented with the challenge of distinguishing their products from the multitude of those offered by their competition. In meeting this challenge, designers are constantly seeking out new features that will cater to a particular niche that has not been exploited, or exploited effectively, by others in the past. The feasibility of a particular feature must of course be balanced against the ultimate cost of the caps incorporating that feature, keeping in mind also the likely size of the consumer base therefor. As a result, baseball-style caps are offered in a wide price range to appeal to different types of customers.

The industry continues to develop new products that will gain the attention of additional potential consumers that have been inundated with headed having different looks, features, etc., and offered in wide ranges of price and quality. One focal area for this effort has been the manner of applying ornamentation to the outside/external surfaces of the cap, and in particular the crown. This ornamentation can generally be divided into two general types: a) that which is directly applied to the headed; and b) that which is pre-formed and subsequently applied to the headed piece, as through a self-contained patch. The application may be through the use of thread, an adhesive, fasteners, etc.

Over the years, ornamentation has been applied to headed and other apparel items as by: a) embroidery using thread with controlled application through computer-aided technology; b) printing; c) metal patch application; d) heat transfer using silicon/rubber, etc. Of these, over the last 20 years, the primary method of applying ornamentation has been through embroidery using automated machines that apply the embroidery using thread, such as that made from polyester or rayon.

The lesser used printing methods generally are silk screen printing, rubber/silicon printing, and the like.

In the heat transfer method, a film with the ornamentation is prepared and transferred through heat application to the particular surface.

The search continues in this industry for additional eye catching ornamentation that has a unique appearance and appeals to a significant customer base.

SUMMARY OF THE INVENTION

In one form, the invention is directed to a headed piece having a crown defining an opening into which a wearer's head can be directed and a brim/bill projecting away from the crown. The crown has an inside surface for engaging a wearer's head, directed into the opening, to thereby maintain the headed piece in an operative position upon the wearer's head. The crown and brim/bill further have an exposed outside surface to which ornamentation is applied. The ornamentation includes bullion wire that is applied to the exposed outside surface so as to define at least a part of a viewable component that consists of at least one of: a) a scene; b) a logo; c) a design; d) a word; e) a letter; and f) a depiction of a: i) person; ii) place; and/or iii) thing.

In one form, the ornamentation has a discrete shape bounded by a border and the ornamentation consists of at least one of bullion wire and non-bullion wire applied to the exposed outside surface along the border so as to outline at least a portion of the discrete shape.

In one form, the discrete shape has an area within the border and the bullion wire is applied to the exposed outside surface to overlie a substantial portion of the area within the border.

In one form, the bullion wire overlying the area within the border consists of a plurality of substantially straight, substantially parallel, lengths of the bullion wire that overlie a substantial portion of the area within the border.

In one form, the border has spaced segments between which the substantially straight, substantially parallel, lengths of the bullion wire extend.

In one form, the substantially straight, substantially parallel, lengths of the bullion wire are in adjacent non-overlapping relationship with each other so as to collectively contiguously cover a substantial portion of the area within the border.

In one form, the bullion wire is applied to the exposed outside surface along the border so as to outline at least a portion of the discrete shape.

In one form, the bullion wire applied to the outside surface along the border is a first type of bullion wire, and the bullion wire defining the plurality of substantially straight, substantially parallel lengths of the bullion wire is a second type of bullion wire. The first and second types of bullion wire are different by reason of at least one of: a) color; b) gauge; c) shape; and d) construction.

In one form: a) at least one of bullion wire and non-bullion wire is applied in a first pattern, made up of substantially straight, substantially parallel lengths within the area bounded by the border; and b) bullion wire is applied in a second pattern, consisting of substantially straight, substantially parallel, lengths within the area bounded by the border and overlying the first pattern. The lengths of wire in the first pattern are transverse to the lengths of bullion wire in the second pattern.

In one form, the lengths of wire in the first pattern are overlapped with each other.

In one form, the substantially straight, substantially parallel, lengths of bullion wire in the second pattern are in adjacent non-overlapping relationship with each other.

The bullion wire may be in the form of coiled or uncoiled wire.

In one form, the plurality of substantially straight, substantially parallel lengths of the bullion wire are defined by bullion wire that is coiled around a core that is held in place by thread extending through the core and into at least one of the crown and the brim/bill.

In one form, the bullion wire applied to the exposed outside surface along the border is held in place at discrete, spaced, locations along the border.

The bullion wire at the discrete, spaced, locations along the border may be held in place by stitched thread.

In one form, the substantially straight, substantially parallel lengths of wire in the first pattern are held in place at discrete locations spaced along the lengths of the bullion wire in the first pattern.

In one form, a substance is applied to the exposed outside surface to visually facilitate placement of the wire upon the exposed outside surface.

In one form, a liner is placed on the inside of the crown at a location where the ornamentation is applied.

In one form, the discrete shape bounded by the border has an area that is substantially entirely covered contiguously by the bullion wire.

In one form, the ornamentation is pre-formed as a patch that is applied to the exposed, outside surface.

In one form, the ornamentation consists of a discrete shape with an area bounded by a border, with the ornamentation consisting of: a) a first pattern consisting of substantially straight, substantially parallel, lengths of wire within the area bounded by the border; and b) a second pattern consisting of substantially straight, substantially parallel, lengths of bullion wire within the area bounded by the border and overlying the first pattern.

In one form, the invention is directed to a headed piece having a crown defining an opening into which a wearer's head can be directed. The crown has an inside surface for engaging a wearer's head, directed into the opening, to thereby maintain the headed piece in an operative position upon the wearer's head. The crown further has an exposed outside surface to which ornamentation is applied. The ornamentation consists of bullion wire that is applied to the exposed outside surface so as to define at least a part of a viewable component that is at least one of: a) a scene; b) a logo; c) a design; d) a word; e) a letter; and f) a depiction of a: i) person; ii) place; and/or iii) thing.

DETAILED DESCRIPTION OF THE DRAWINGS

Figure 1:
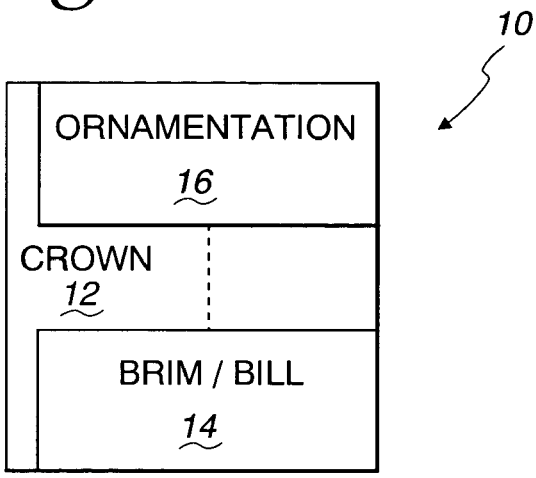
FIG. 1 is a schematic representation of one form of headed piece, made according to the present invention, and including a crown and brim/bill with ornamentation on at least the crown.

In FIG. 1, a headed piece, of the type suitable for incorporation of the present invention, is shown at 10. The headed piece 10 consists of a crown 12 having an associated brim/bill 14 extending angularly away from the crown 12 and partially or fully around the circumference thereof. Ornamentation 16, according to the present invention, is applied to the crown 12 and, optionally, additionally to the brim/bill 14.

The headwear piece 10 is shown schematically in that the particular design thereof is not critical to the present invention. The invention contemplates virtually an unlimited number of configurations for the crown 12 and brim/bill 14. The ornamentation 16 is likewise shown schematically since it, likewise, can have virtually a limitless number of different forms, consistent with the teachings hereinbelow.

Figure 2:
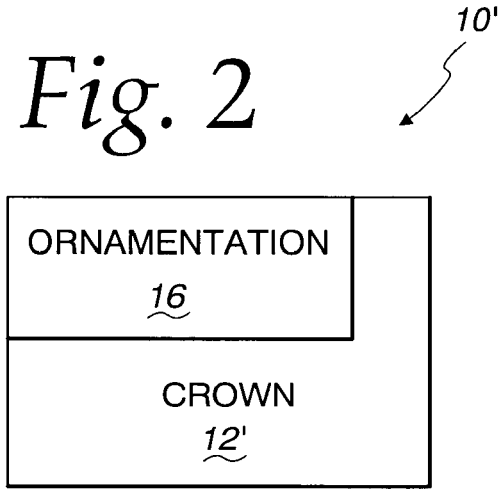
FIG. 2 is a schematic representation of another form of headed piece having a crown without a brim/bill and having ornamentation, according to the present invention, upon the crown.

The inventive ornamentation 16 can be applied to another type of headed piece 10', as shown in FIG. 2. The headed piece 10' differs from the headed piece 10 by reason of the headed piece 10' having a crown 12' but no brim/bill. The ornamentation 16 is applied to the crown 12' in a manner similar to how it is applied to the crown 12 on the headed piece 10.

Figure 3:
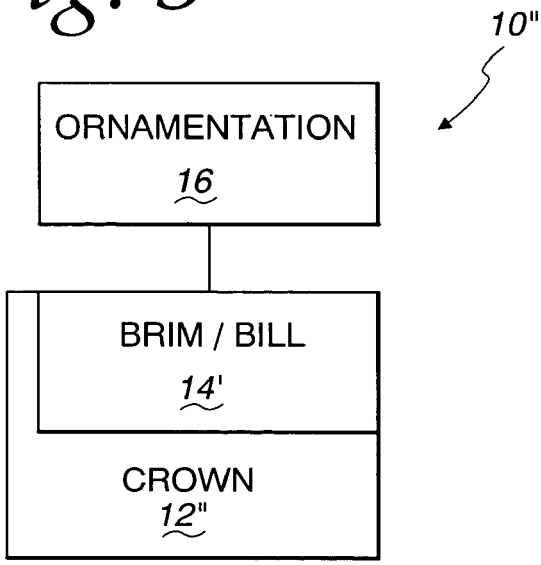
FIG. 3 is a schematic representation of a still further modified form of headed piece, as in FIG. 1, wherein ornamentation, according to the invention, is on the brim/bill and not on the crown.

In FIG. 3, a further variation of a generic form of headed piece is shown at 10". The headed piece 10" has a crown 12" with a brim/bill 14', wherein the inventive ornamentation 16 is provided on the brim/bill 14', but not on the crown 12".

Other variations of the basic structure upon which the inventive ornamentation 16 is applied are contemplated.

Figure 4:
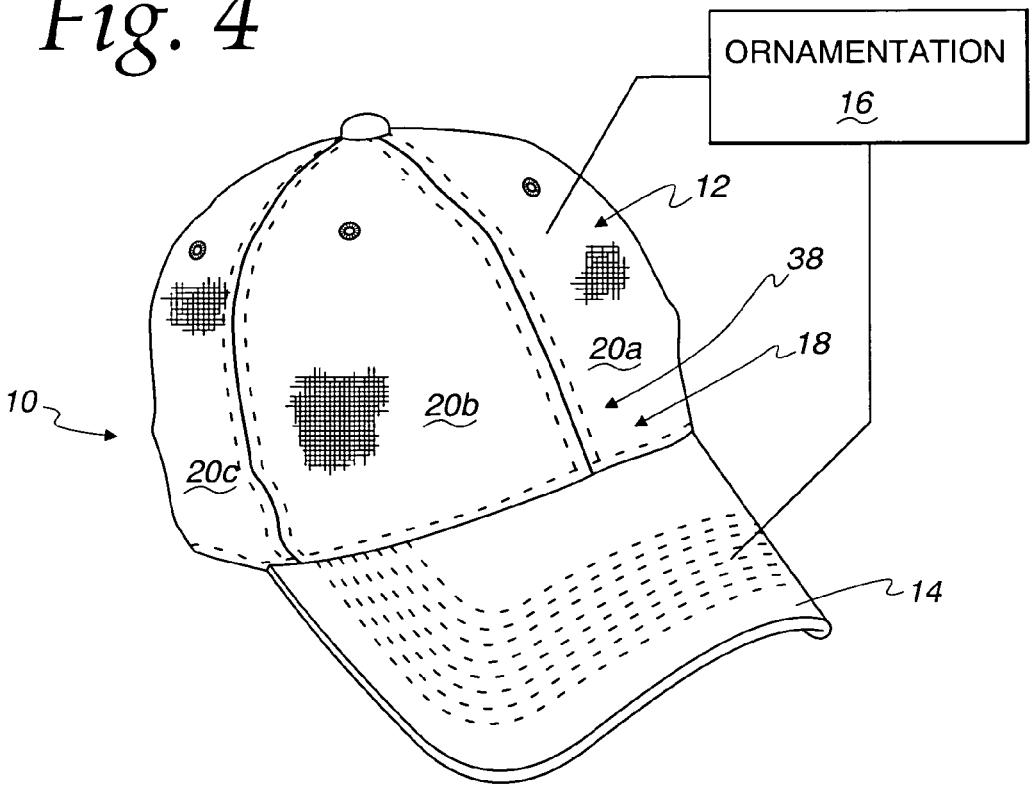
FIG. 4 is a perspective view of one specific form of headed piece, as shown in FIG. 1, in the form of a baseball-style cap, with the inventive ornamentation shown in schematic form thereon.
Figure 5:
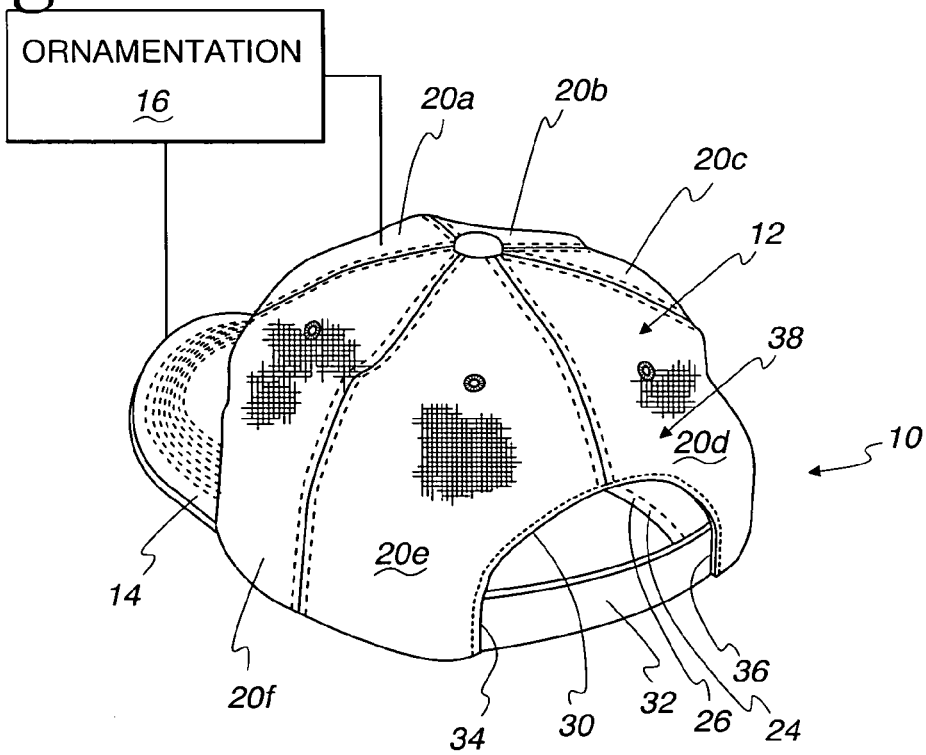
FIG. 5 is a rear perspective view of the headed piece in FIG. 4.
Figure 6:
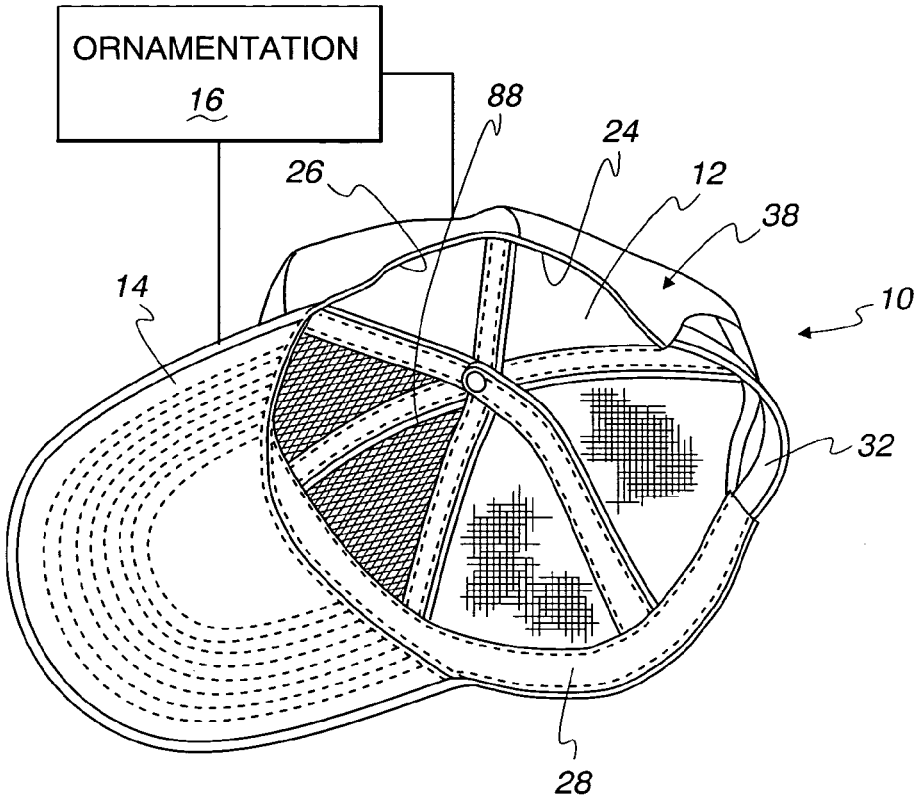
FIG. 6 is a bottom perspective view of the headed piece in FIGS. 4 and 5.

One specific form of the headed piece 10, as depicted in FIG. 1, is shown in detail in FIGS. 4-6 as a baseball-style cap. Briefly, the baseball-style cap 10, which can be constructed in forms different than shown and described herein, consists of the aforementioned crown 12 and a brim/bill 14 projecting angularly forwardly from the front region 18 of the crown 12.

The crown 12 consists of a plurality of, and in this case six (6), triangularly-shaped panels/gores 20*a*, 20*b*, 20*c*, 20*d*, 20*e*, 20*f*, sewn edge-to-edge to produce an inverted cup-shaped configuration with a downwardly opening receptacle 22 for a wearer's head. The bottom of the receptacle 22 has an opening 24 through which a wearer's head is directed to place the headed piece 10 in an operative position. With the user's head directed into the opening 24, an inside surface 26 of the crown 12, bounding the opening 24, embraces the wearer's head to maintain the headed piece 10 in the operative position. An optional sweat band 28 extends around the surface 26. At the rear of the crown 12, an inverted, U-shaped opening 30 is formed.

A backstrap 32 connects between spaced edges 34, 36 of the crown 12, bounding the opening 30. The backstrap 32 may be made adjustable or stretchable to accommodate different head sizes, or may be substantially fixed in length.

The brim/brill 14 projects angularly from the front region 18 of the crown 12 and is secured to what are generally referred to as the two front panels 20*a*, 20*b* of the crown 12, as by stitching. The crown 12 and brim/bill 14 define a contiguous, exposed, outside surface 38 to which the inventive ornamentation 16 can be applied.

Figure 7:
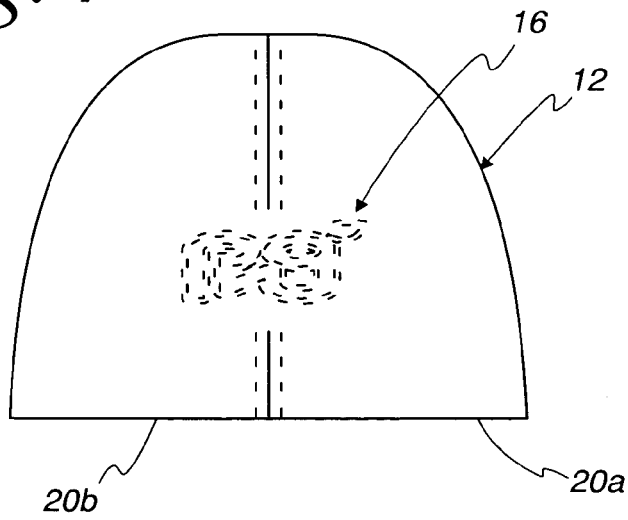
FIG. 7 is an elevation view of the front of the crown on the headed piece in FIGS. 4-6 with the outline of one exemplary form of ornamentation, according to the present invention, thereon.
Figure 8:
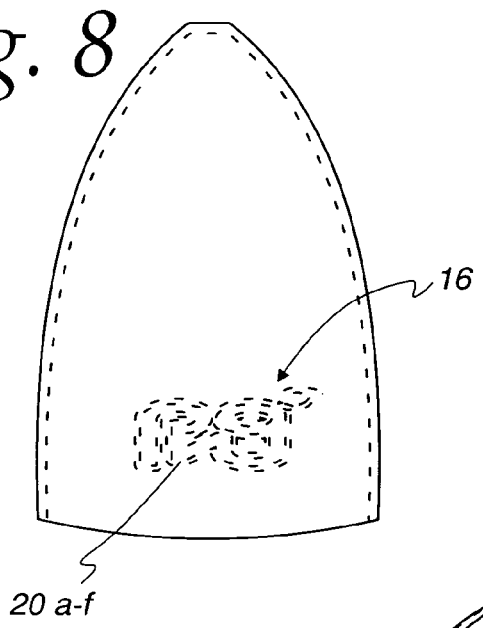
FIG. 8 is an elevation view of an exemplary panel on the headed piece in FIGS. 4-6 with the outline of the same exemplary inventive ornamentation thereon as in FIG. 7.
Figure 9:
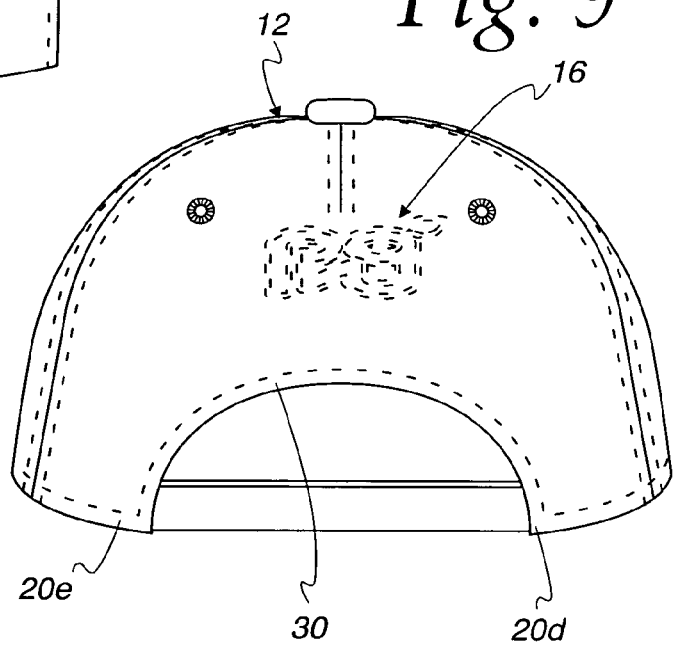
FIG. 9 is a rear elevation view of the headed piece in FIGS. 4-6 with the outline of the same exemplary inventive ornamentation thereon, as in FIGS. 7 and 8, at a third, alternative location.
Figure 10:
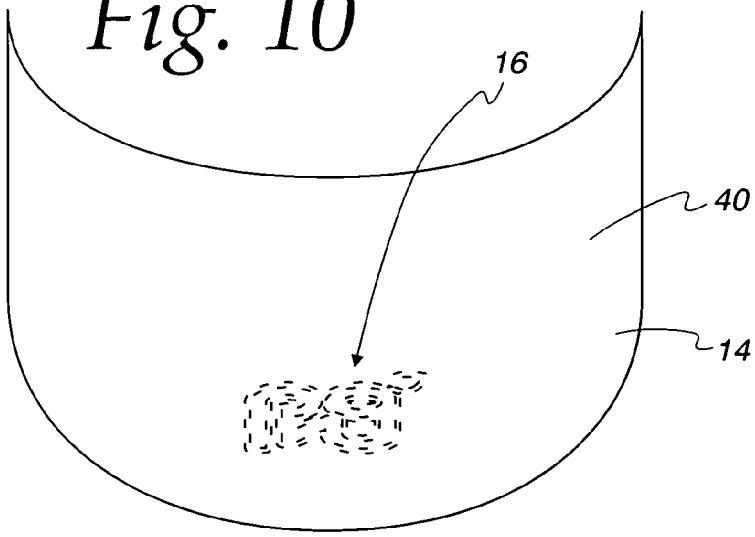
FIG. 10 is a plan view of the brim/bill on the headed piece in FIGS. 4-6 with the outline of the same exemplary inventive ornamentation thereon, as in FIGS. 7-9, at a fourth, alternative location.

The ornamentation 16 can be applied at any location on the exposed outside surface 38 of the headed piece 10. The outline of the company logo for the assignee herein, as just one exemplary form of the ornamentation 16, is shown at different exemplary locations in FIGS. 7-10. In FIG. 7, the ornamentation 16 is shown extending continuously between the front panels 20*a*, 20*b* on the crown 12. In FIG. 8, the ornamentation 16 is shown within any of the panels/gores 20*a*-20*f*. In FIG. 9, the ornamentation 16 is shown centered between, and on, the back panels 20*d*, 20*e* over the opening 30. In FIG. 10, the ornamentation 16 is shown on an upwardly facing surface 40 of the brim/bill 14. As noted, these specific locations are only exemplary in nature as the ornamentation 16 can be selectively placed anywhere upon the exposed outside surface 38.

Figure 11:
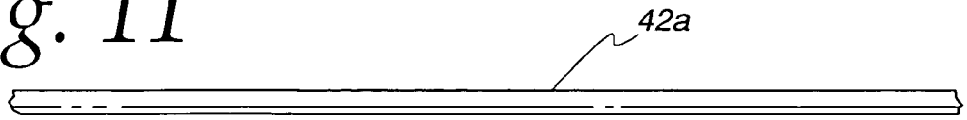
FIG. 11 is an enlarged perspective view of a length of a non-coiled bullion wire usable to form the inventive ornamentation.
Figure 12:
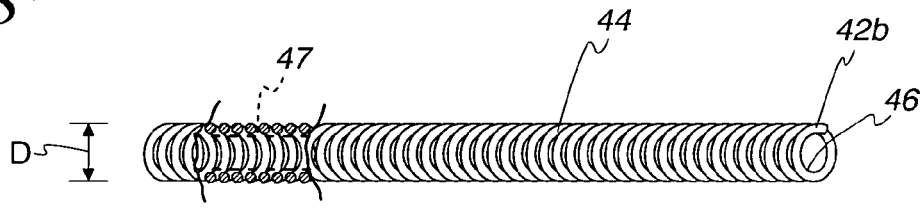
FIG. 12 is an enlarged, perspective view of a length of bullion wire in coiled form usable to form the inventive ornamentation.

To produce the ornamentation 16, bullion wire, in uncoiled form, as shown at 42*a* in FIG. 11, and/or in coiled form at 42*b* in FIG. 12, is used. The wire 42*a*, 42*b* preferably has a diameter in the range of 0.5 to 2.0 mm, though this range should not be viewed in any way as limiting. The diameter D produced by the coiled bullion wire 42*b* may vary, as a particular application or look dictates. The individual coils 44 extend around a hollow core 46. Optionally, thread(s) 47 may extend through the core 46.

Figure 13:
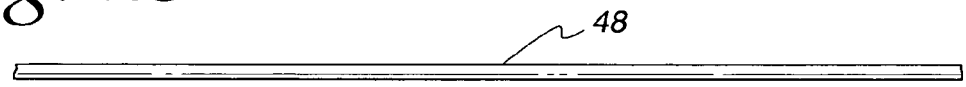
FIG. 13 is an enlarged, perspective view of a length of non-bullion wire usable to form the inventive ornamentation.

As shown in FIG. 13, the ornamentation 16 can be formed by using, in addition to one or both forms of the bullion wire 42*a*, 42*b*, single or multi-filament wire/thread 48 made from any type of appropriate filament that would be known to those skilled in the art.

Figure 14:
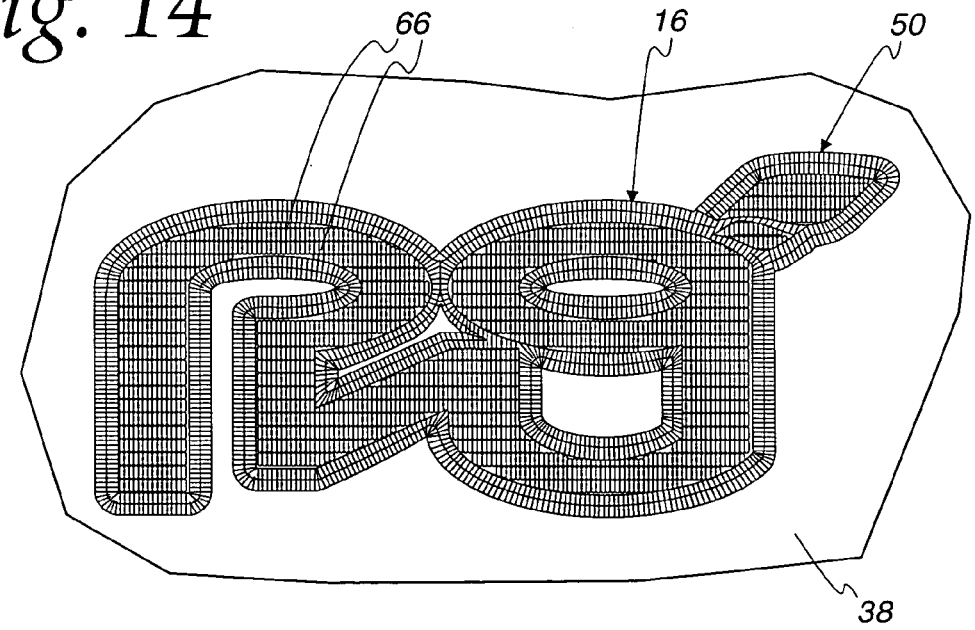
FIG. 14 is a fragmentary, elevation view of a portion of a headed piece with the inventive ornamentation, as outlined in FIGS. 7-10, thereon and in a completed form.

The ornamentation 16 produces a viewable component, in this case the logo of the assignee herein as shown in completed form in FIG. 14, on any location on, and in any orientation with respect to, the exposed outside surface 38. The precise nature of the viewable component produced by the ornamentation 16 is not critical to the present invention. As examples, the ornamentation 16 is such as to define at least a part of a viewable component that consists of at least one of a: a) scene; b) a logo; c) a design; d) a word; e) a letter; and f) a depiction of a: i) person; ii) place; and/or iii) thing. The detailed process for forming the ornamentation 16 will be described with respect to the exemplary logo ornamentation 16 shown in FIG. 14.

Figure 15:
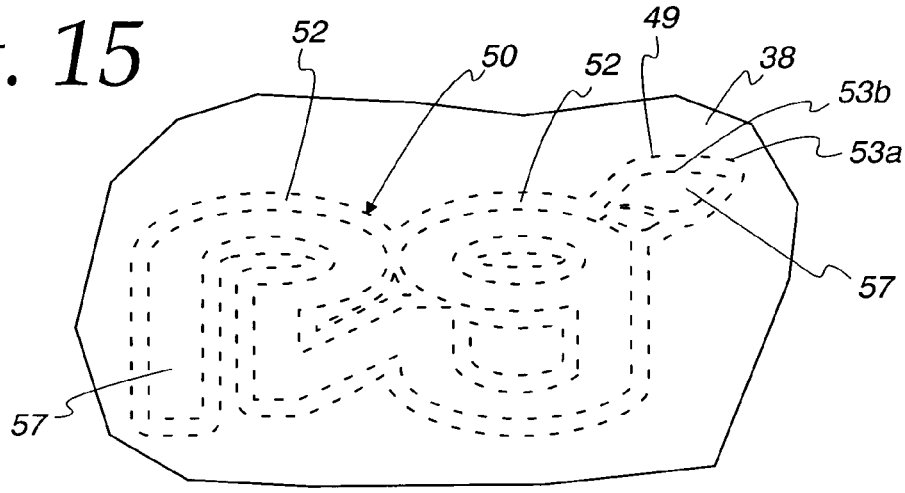
FIG. 15 is a view as in FIG. 14 wherein a border for the inventive ornamentation in FIG. 14 is outlined as an initial step in applying the FIG. 14 ornamentation.

Initially, as shown in FIG. 15, an artwork layout is prepared. A component 49 is applied to the surface 38 to visually identify the location of a border 50 around a discrete shape, and in this case the logo. The border 50 extends continuously to define the three letters "P", "N" and "G" and has a thickness defined by an area 52 within spaced lines 53*a*, 53*b*. The component 49 may be applied so as to produce a dotted pattern around the border 50. The component 49 may be chalk, thread applied as through the use of a computer-controlled embroidery machine, etc.

Figure 16:
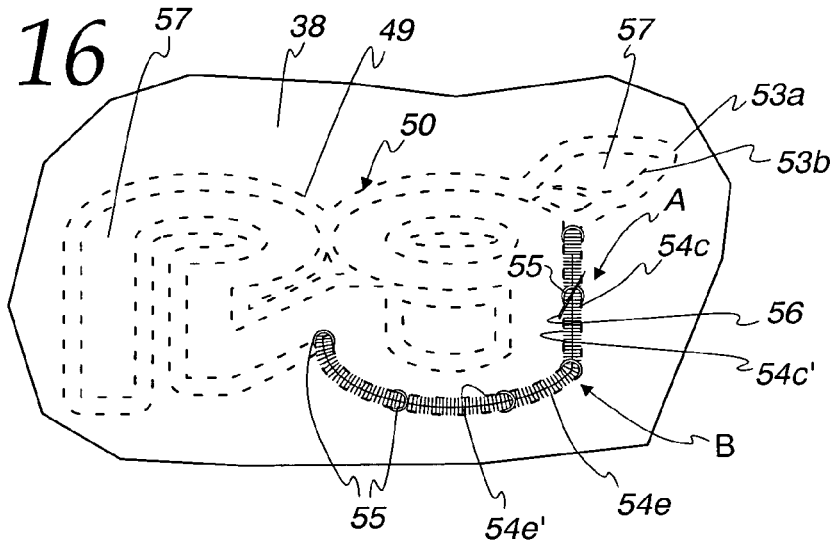
FIGS. 16-18 show the steps of progressively applying bullion wire and/or non-bullion wire/thread to define the border on the ornamentation outlined in FIG. 15.
Figure 17:
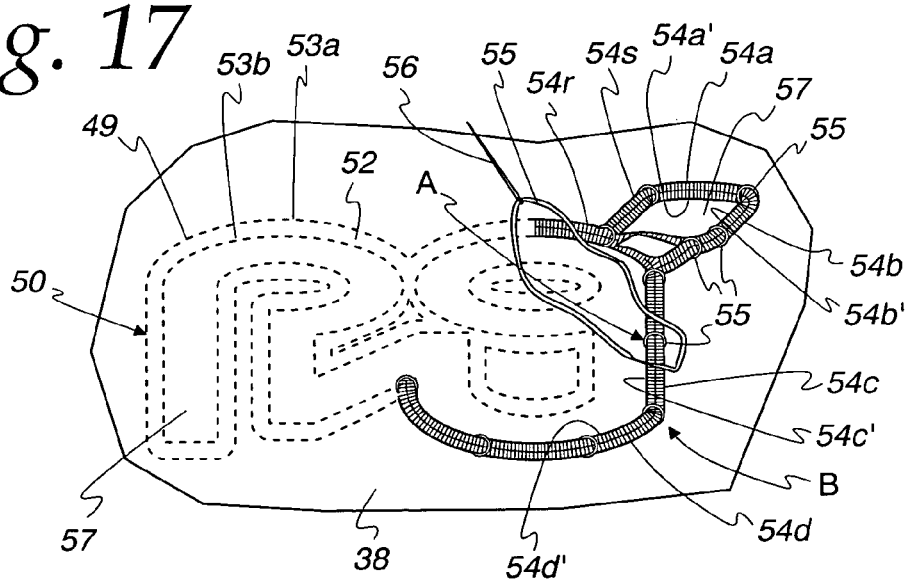
Figure 18:
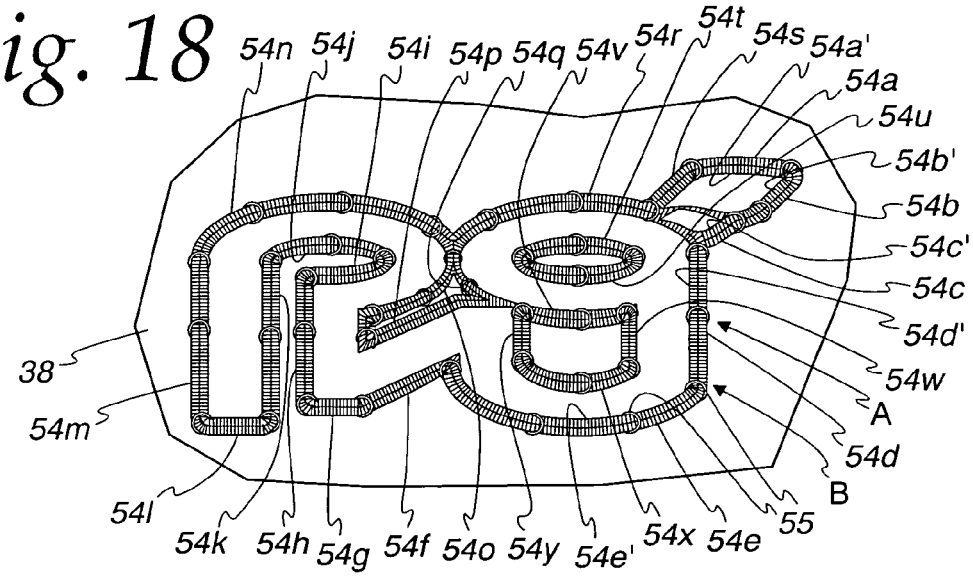

The next step involves the primary formation of the border 50 as shown progressively in FIGS. 16-18. The border 50 may be formed by using the bullion wire 42*a*, 42*b* and/or the wire/thread 48. Preferably, for purposes of appearances, a thin bullion wire 42*a*, 42*b* is used. The bullion wire 42*a*, 42*b*, and/or wire/thread 48 is aligned conformingly over the border 50 and secured to the exposed, outside surface 38. More specifically, conforming border segments 54*a*-54*y* are progressively aligned over discrete lengths on the border 50, as shown sequentially in FIGS. 16-18, and secured to the surface 38 by thread 55 that is stitched around the bullion wire 42*a*, 42*b* and/or wire/thread 48 and to the exposed outside surface 38 at discrete locations. Two exemplary securing locations are identified at A and B. It is preferred that the thread 55 be stitched at locations where adjacent segments 54*a*-54*y* abruptly change directions and at sufficiently short intervals along the border 50 that the bullion wire 42*a*, 42*b* and/or wire/thread 48 precisely conforms to, and is maintained in, the desired border shape.

While it is contemplated that the border 50 may be formed by a single width of bullion wire 42*a*, 42*b* and/or wire/thread 48. In this embodiment, a double width of the bullion wire 42*a*, 42*b* and/or wire/thread 48 defines the border 50. That is, border segments of the bullion wire 42*a*, 42*b* and/or wire/thread 48 are conformed to the border 50 adjacent to, and preferably abut the border segments 54*a*-54*y*. Representative segments are identified in FIG. 18 as 54*a'*-54*e'*, conforming to and abutting segments 54*a*-54*e*, consecutively. Like, adjacent/abutting segments are shown along the remainder of the border 50. The stitching of the thread 55 at the discrete locations can be performed by hand, as through a needle 56, or through a machine. The thread 55 may be stitched to the bullion wires 42*a*, 42*b* and/or wire/thread 48 one at a time or simultaneously at each of the discrete locations.

Alternatively, the border 50 could be formed by a thread that can be continuously stitched to be held in placed as opposed to being spot stitched.

As a still further alternative, the bullion wire 42*a*, 42*b* or wire/thread 48 could be held in place by other means, such as an adhesive, discrete, separate fasteners, etc.

To optionally produce a raised and/or crowned shape for the ornamentation 16, the areas 57 within the border 50 have a bullion wire 42*a*, 42*b* and/or wire/thread 48 applied thereto. The bullion wire 42*a*, 42*b* and/or wire/thread 48 may have a heavier gauge to facilitate filling of the areas 57 to a desired height/thickness.

Figure 19:
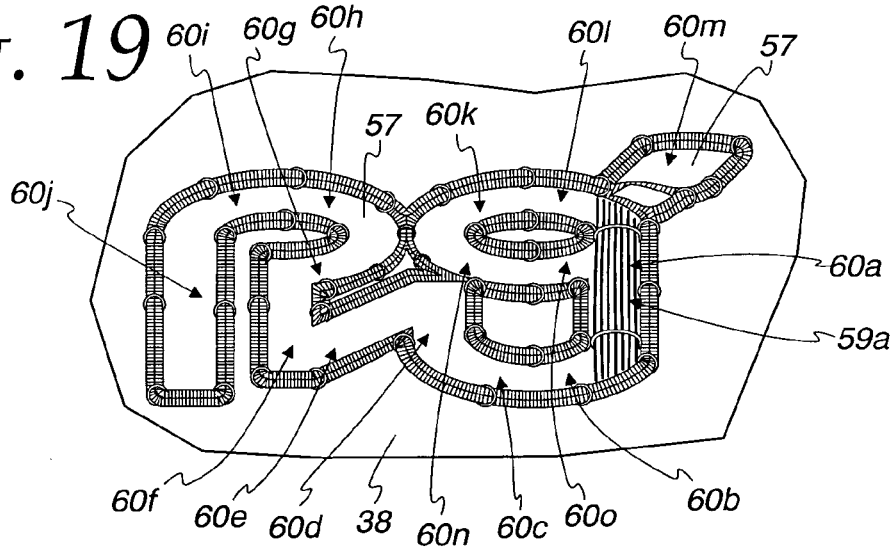
FIGS. 19-21 show the steps of progressively forming a first pattern of bullion wire and/or non-bullion wire/thread in an area bounded by the border as formed in FIG. 18.
Figure 20:
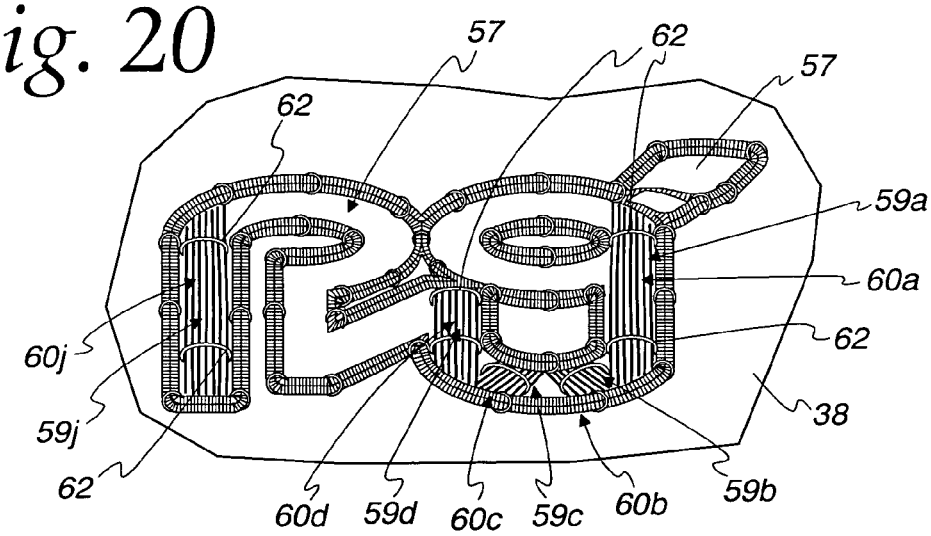
Figure 21:
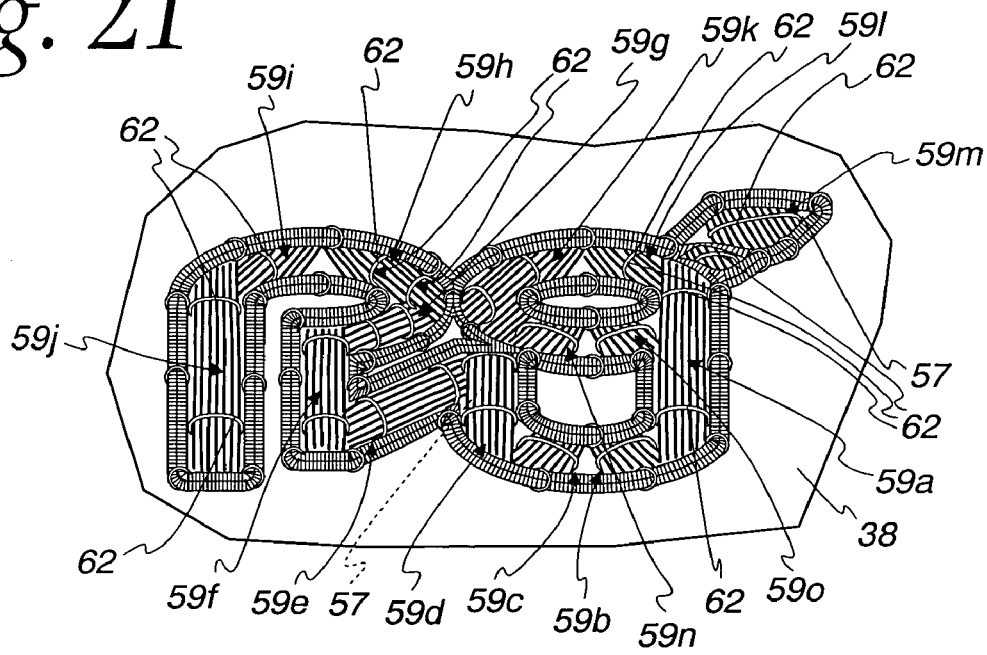

More particularly, as shown in FIGS. 19-21, a plurality of substantially straight, substantially parallel, discrete lengths of the thicker bullion wire 42*a*, 42*b* and/or wire/thread 48 are applied to the surface 38 of the areas 57 within the border 50. The lengths may be side-by-side and/or in overlapping relationship with each other in groups 59*a*-59*o*, each applied to the surface 38 to fill different regions of the areas 57. More specifically, as shown in FIG. 19, the areas 57 can be arbitrarily divided into regions 60*a*-60*o* in which the groups 59*a*-59*o* can be respectively applied in a first pattern, with the lengths of the bullion wire 42*a*, 42*b* and/or wire/thread 48 in each group 59*a*-59*o* aligned, in other than a horizontal direction.

As seen in FIG. 19, the initially applied group 59*a* is applied in the vertically extending region 60*a* with the lengths of the bullion wire 42*a*, 42*b* and/or wire/thread 48 in the group 59*a* oriented vertically. This process is repeated progressively, as shown in FIG. 20 for the groups 59*a*-*d* and 59*j* applied in the regions 60*a*-*d* and 50*j*, consistently, until all regions 60*a*-60*o* are covered by the groups 59*a*-59*o*, as shown in FIG. 21. However, the regions 50*a*-60*o* do not have to all be fully covered.

The groups 59*a*-59*o* may be made with a single layer of the bullion wire 42*a*, 42*b* and/or wire/thread 48 or with multiple layers thereof. The overlapping of the bullion wire 42*a*, 42*b* and/or wire/thread 48 may be performed so that each group 59*a*-59*o* is thickest at a widthwise center location, and tapers to side edges.

The groups 59*a*-59*o* are maintained against the outside surface 38, as by using stitched thread 62 at a plurality of spaced locations. Alternatively, an adhesive, fasteners, or the like can be used for this purpose.

As an alternative to using the bullion wire 42*a*, 42*b*, a thick, bulkier wire/thread 48 or yarn is preferred to produce a raised pattern within the areas 57.

Figure 22:
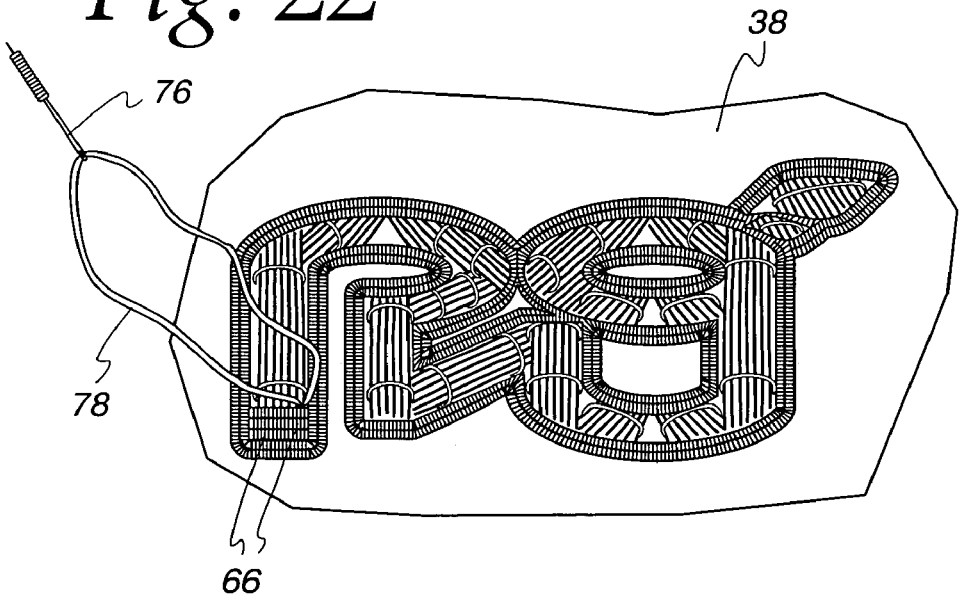
FIGS. 22 and 23 show the steps of progressively applying a second pattern of bullion wire towards completing the ornamentation to the completed form shown in FIG. 14.
Figure 23:
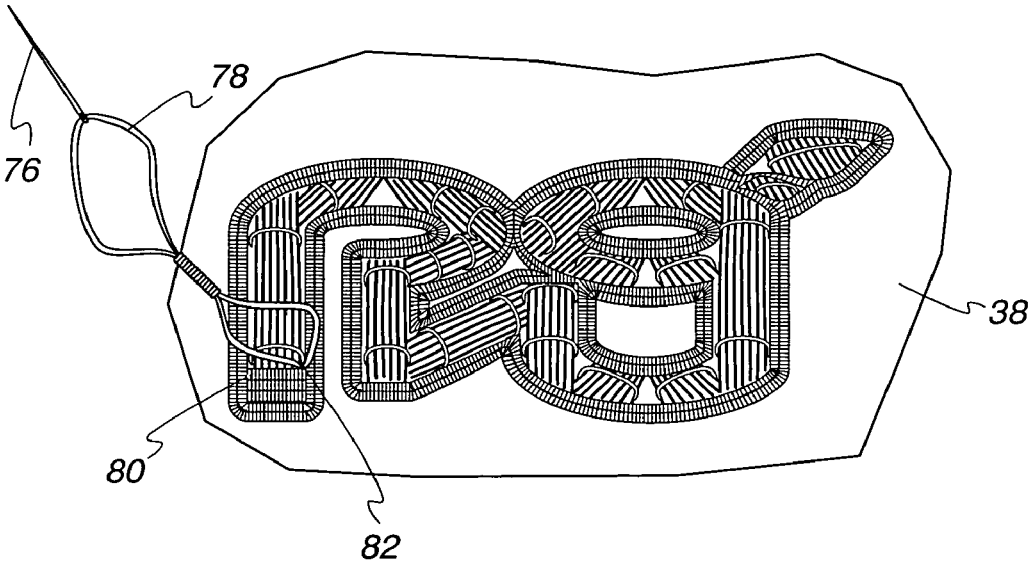

Once the groups 59*a*-59*o* are applied in first pattern, bullion wire 42*a*, 42*b*, preferably in its coiled form 42*b*, is applied in a second pattern, as shown in FIGS. 22 and 23. More particularly, discrete lengths 66 of the bullion wire 42*b* are cut to reside between spaced border segments 54*a*-54*y*; 54*a'*-54*y'* throughout the areas 57 with the lengths 66 horizontally oriented in a second pattern wherein substantially all, if not all, of the lengths 66 are transverse to the lengths of the bullion wire 42*a*, 42*b* and/or wire/thread 48 in the groups 59*a*-59*o* in the first pattern. This transverse arrangement avoids wedging of overlying lengths 66 between adjacent, underlying wires 42*a*, 42*b* and/or threads 48 and/or skewing of the lengths 66 from their desired, closely adjacent, parallel, alignment. The overlying lengths 66 of bullion wire 42*b* span across the outside of the underlying wires 42*a*, 42*b* and/or threads 48 without being interwoven therewith.

In a preferred, but not a required, form, a needle 76 carrying thread 78 is directed through the core 46 of each length 66. By then controllably directing the needle 76 through the outside surface 38 at locations 80, 82 adjacent to the representative, horizontally spaced, border segments in FIGS. 22 and 23 between which each length 66 extends, each of the lengths 66 can be controllably placed and maintained in abutting, non-overlapping, parallel relationship, with an adjacent length or lengths 66. This is repeated throughout the entire area 57, with the lengths 66 in the second pattern oriented transversely to the lengths of the bullion wire 42*a*, 42*b* and/or wire/thread 48 in the first pattern. This process is repeated until the ornamentation 16 is completed, as shown in FIG. 14, wherein the lengths 66 preferably fully and contiguously cover the area 57. However, this full coverage is not a requirement. It may be desirable to leave exposed bullion wire 42*a*, 42*b* and/or wire/thread 48 in the underlying groups 59*a*-59*o*.

By reason of the aforementioned application of the threads 42*a*, 42*b* and/or wire/thread 48, eye catching appearances for the ornamentation 16 can be produced. The bullion wire 42*a*, 42*b* can be made with different materials to produce desired colors and contrast. For example, it is known to use bullion wire with plating of 24 k gold, silver chrome, colored chrome, copper, etc. High end headed may be offered, with the bullion wire defining the ornamentation to many different types of users and for many different purposes. Also, the different diameters and types (coiled and uncoiled) can be intermingled to produce a unique visual effect. For example, the border 50 can be made with bullion wire 42*a*, 42*b* and/or wire/thread 48 that is a different type than that which defines the lengths 66, to produce a contrasting appearance. The difference may be in color, gauge, shape, construction, etc.

As another variation, it is not required that the lengths 66 be horizontally oriented. They may be vertically oriented or in an intermediate orientation. The orientation thereof may also vary within the areas 57.

Figure 24:
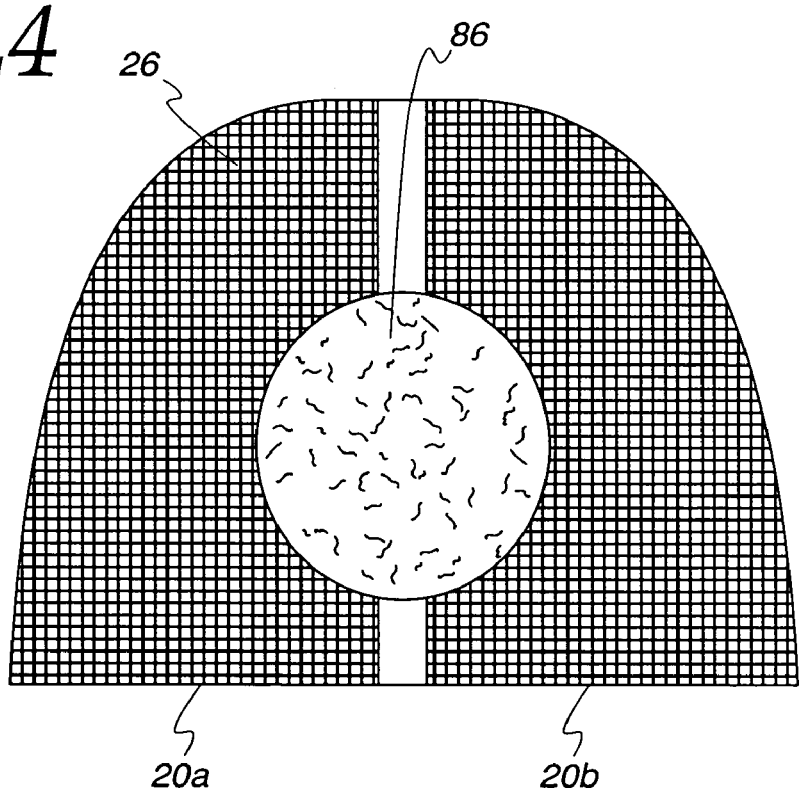
FIG. 24 is an enlarged, fragmentary, elevation view of the inside surface of the crown on the headed piece in FIGS. 4-6 with a backing layer thereon at the location at which the ornamentation is applied.

As shown in FIG. 24, to facilitate direct application of the ornamentation 16, a backing layer 86 may be placed on the inside surface 26 of the crown at a location which the ornamentation 16 is formed. The backing layer 86 may be made from thin felt paper, or the like. Normally, no such backing would be required on the brim/bill 14. In FIG. 24, the inside surface 26 is shown with a buckram backing layer 86, as is typically used behind the front panels 20*a*, 20*b*, shown also in FIG. 24.

Figure 25:
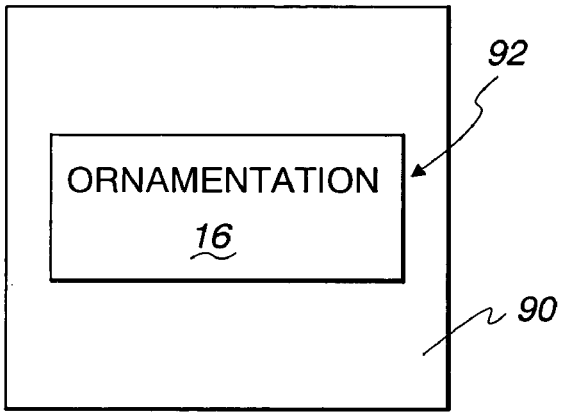
FIG. 25 is a schematic representation of a pre-formed patch, including a substrate layer with the inventive ornamentation thereon, that can be placed on an item.

As an alternative to forming the ornamentation 16 directly upon the headed piece 10, as shown in FIG. 25, the ornamentation 16 can be formed, in the same manners described above, or in another manner, upon a substrate 90 that is separate from the headed piece 10. The substrate 90 can be pre-formed to the desired end shape or cut, as after the formation of the ornamentation 16 thereon. The ornamentation 16 upon the substrate 90 produces a patch 92 that can be applied as by an adhesive, fasteners, thread, etc. to the headed piece 10.

Figure 26:
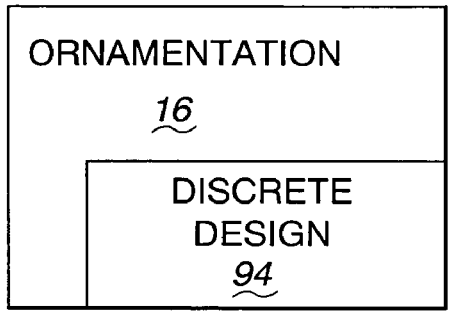
FIG. 26 is a schematic representation of a modified form of ornamentation, according to the invention, wherein a discrete design is formed using bullion wire.

As shown in FIG. 26, the invention also contemplates a discrete design 94 on the ornamentation 16 that may be formed using the bullion wire 42*a*, 42*b*. For example, small letters may be formed by stitching a small gauge bullion wire 42*a*, 42*b*, as to be used in conjunction with the remainder of the ornamentation 16, described above, or other type(s) of ornamentation.

Figure 27:
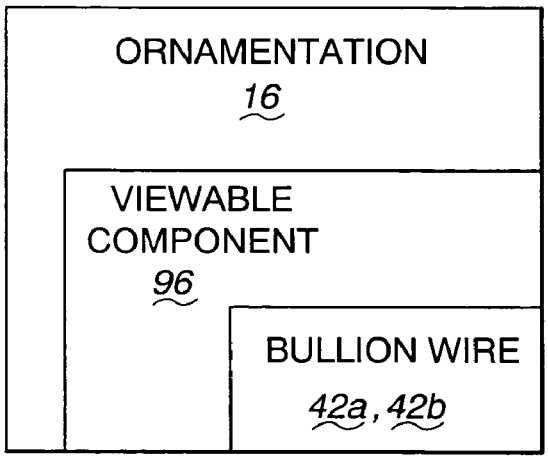
FIG. 27 is a schematic representation of a generic form of ornamentation, according to the present invention, having a viewable component with at least a part thereof formed by bullion wire.

As shown in FIG. 27, the invention further contemplates other ornamentation 16 so long as there is a viewable component 96 defined at least in part by applied bullion wire 42*a*, 42*b*.

The foregoing disclosure of specific embodiments is intended to be illustrative of the broad concepts comprehended by the invention.

The invention claimed is:

1. A headwear piece comprising:

a crown defining an opening into which a wearer's head can be directed; and a brim/bill projecting away from the crown, the crown having an inside surface for engaging a wearer's head directed into the opening to thereby maintain the headwear piece in an operative position upon the wearer's head, the crown and brim/bill further having an exposed outside surface to which ornamentation is applied, the ornamentation comprising bullion wire that is applied to the exposed outside surface so as to define at least a part of a viewable component that comprises at least one of: a) a scene; b) a logo; c) a design; d) a word; e) a letter; and f) a depiction of a: i) person; ii) place; and/or iii) thing, wherein the ornamentation comprises a discrete shape with an area bounded by a border, and the ornamentation comprises: a) wire that is at least one of bullion wire and non-bullion wire applied in a first pattern comprising substantially straight, substantially parallel, adjacent lengths of the at least one of bullion wire and non-bullion wire within the area bounded by the border that collectively contiguously cover a substantial portion of the area bounded by the border; and b) bullion wire applied in a second pattern comprising substantially straight, substantially parallel, adjacent lengths of bullion wire within the area bounded by the border and overlying the first pattern, wherein the lengths of bullion wire in the second pattern are transverse to the lengths of wire in the first pattern and collectively contiguously cover a substantial portion of the area bounded by the border, a plurality of the lengths of the bullion wire in the second pattern each spanning across a plurality of the lengths of the wire in the first pattern without being interwoven with the spanned plurality of lengths of wire in the first pattern.

2. The headwear piece according to claim 1 wherein the ornamentation comprises at least one of bullion wire and non-bullion wire applied to the exposed outside surface along the border so as to outline at least a portion of the discrete shape.

3. The headwear piece according to claim 1 wherein the border has spaced segments between which the substantially straight, substantially parallel lengths of the bullion wire extend.

4. The headwear piece according to claim 1 wherein the ornamentation comprises bullion wire applied to the exposed outside surface along the border so as to outline at least a portion for the discrete shape.

5. The headwear piece according to claim 4 wherein the bullion wire applied to the outside surface along the border is a first type of bullion wire, and the bullion wire defining the plurality of substantially straight, substantially parallel lengths of the bullion wire comprises a second type of bullion wire, the first and second types of bullion wire being different by reason of at least one of: a) color; b) gauge; c) shape; and d) construction.

6. The headwear piece according to claim 1 wherein the lengths of wire in the first pattern are overlapped with each other.

7. The headwear piece according to claim 6 wherein the substantially straight, substantially parallel, lengths of bullion wire in the second pattern are in adjacent non-overlapping relationship with each other.

8. The headwear piece according to claim 1 wherein the bullion wire is uncoiled wire.

9. The headwear piece according to claim 1 wherein the bullion wire comprises coiled wire.

10. The headwear piece according to claim 1 wherein the plurality of substantially straight, substantially parallel lengths of the bullion wire are defined by bullion wire that is coiled around a core and is held in place by thread extending through the core and into at least one of the crown and the brim/bill.

11. The headwear piece according to claim 2 wherein the bullion wire applied to the exposed outside surface along the border is held in place at discrete, spaced locations along the border.

12. The headwear piece according to claim 11 wherein the bullion wire applied to the exposed outside surface along the border is held in place at the discrete, spaced locations along the border by stitched thread.

13. The headwear piece according to claim 1 wherein the substantially straight, substantially parallel lengths of wire in the first pattern are held in place at discrete locations spaced along the lengths of the bullion wire.

14. The headwear piece according to claim 1 wherein a substance is applied to the exposed outside surface to visually facilitate placement of the bullion wire upon the exposed outside surface.

15. The headwear piece according to claim 1 wherein a liner is placed on the inside of the crown at a location where the ornamentation is applied.

16. The headwear piece according to claim 1 wherein the bullion wire in the second pattern contiguously covers substantially the entire area bounded by the border.

17. The headwear piece according to claim 1 wherein the ornamentation is pre-formed as a patch that is applied to the exposed, outside surface.

18. A headwear piece comprising:

a crown defining an opening into which a wearer's head can be directed;

the crown having an inside surface for engaging a wearer's head directed into the opening to thereby maintain the headwear piece in an operative position upon the wearer's head, the crown further having an exposed outside surface to which ornamentation is applied, the ornamentation comprising bullion wire that is applied to the exposed outside surface so as to define at least a part of a viewable component that comprises at least one of: a) a scene; b) a logo; c) a design; d) a word; e) a letter; and f) a depiction of a: i) person; ii) place; and/or iii) thing, wherein the ornamentation comprises a discrete shape with an area bounded by a border, and the ornamentation comprises: a) wire that is at least one of bullion wire and non-bullion wire applied in a first pattern comprising substantially straight, substantially parallel, adjacent lengths of the at least one of bullion wire and non-bullion wire within the area bounded by the border that collectively contiguously cover a substantial portion of the area bounded by the border; and b) bullion wire applied in a second pattern comprising substantially straight, substantially parallel, adjacent lengths of bullion wire within the area bounded by the border and overlying the first pattern, wherein the lengths of bullion wire in the second pattern are transverse to the lengths of wire in the first pattern and collectively contiguously cover a substantial portion of the area bounded by the border.

a plurality of lengths of the bullion wire in the second pattern each spanning across a plurality of the lengths of the wire in the first pattern without being interwoven with the spanned plurality of lengths of wire in the first pattern.

* * * * *